United States Patent [19]

Wada et al.

[11] Patent Number: 4,960,652

[45] Date of Patent: Oct. 2, 1990

[54] GRAIN-ORIENTED ELECTRICAL STEEL SHEET HAVING A LOW WATT LOSS

[75] Inventors: Toshiya Wada; Osamu Tanaka; Takatoshi Egawa; Makato Yoshida; Seizun Higuchi; Teruaki Izaki, all of Kitakyushu, Japan

[73] Assignee: Nippon Steel Corporation, Tokyo, Japan

[21] Appl. No.: 470,997

[22] Filed: Jan. 22, 1990

Related U.S. Application Data

[63] Continuation of Ser. No. 946,963, Dec. 29, 1986, abandoned, which is a continuation-in-part of Ser. No. 786,616, Oct. 11, 1985, abandoned.

[30] Foreign Application Priority Data

| | | | |
|---|---|---|---|
| Oct. 15, 1984 | [JP] | Japan | 59-215823 |
| Nov. 6, 1984 | [JP] | Japan | 59-232394 |
| Nov. 12, 1984 | [JP] | Japan | 59-236641 |
| Nov. 13, 1984 | [JP] | Japan | 59-237446 |
| Dec. 13, 1984 | [JP] | Japan | 59-261685 |
| Feb. 9, 1985 | [JP] | Japan | 60-22762 |
| Feb. 13, 1985 | [JP] | Japan | 60-24427 |
| Apr. 18, 1985 | [JP] | Japan | 60-81433 |

[51] Int. Cl.[5] ..... H01F 1/16

[52] U.S. Cl. ..... 428/611; 148/307; 148/308; 420/117

[58] Field of Search ..... 148/307, 308; 420/117; 428/611

[56] References Cited

U.S. PATENT DOCUMENTS

| | | | |
|---|---|---|---|
| 3,990,923 | 11/1976 | Takashina et al. | 148/111 |
| 4,203,784 | 5/1980 | Kuroki et al. | 148/111 |
| 4,363,677 | 12/1982 | Ichiyama et al. | 148/111 |
| 4,548,656 | 10/1985 | Kimoto et al. | 148/111 |
| 4,554,029 | 11/1985 | Schoen et al. | 148/112 |

FOREIGN PATENT DOCUMENTS

| | | | |
|---|---|---|---|
| 60-103124 | 6/1985 | Japan | 148/111 |

*Primary Examiner*—John P. Sheehan

*Attorney, Agent, or Firm*—Kenyon & Kenyon

[57] ABSTRACT

A grain-oriented electromagnetic steel sheet has an ultra low watt loss and heat resistant subdivided magnetic domains. The electromagnetic steel sheet has spaced apart regions of plastic strain and an insulating coating disposed thereon. Intruders are thermally intruded into the spaced apart regions of plastic strain causing the subdivided magnetic domains to be heat resistant and maintaining the subdivided magnetic domains after stress relief annealing. Preferred intruders include Sb and Sb containing materials.

6 Claims, 5 Drawing Sheets

SLANT CROSS SECTIONAL VIEW
(X 2000)

GRAIN-ORIENTED ELECTRICAL STEEL SHEET HAVING A LOW WATT LOSS

This application is a continuation of application Ser. No. 946,963, filed Dec. 29, 1986, now abandoned, which in turn is a continuation-in-part of application Ser. No. 786,616, filed Oct. 11, 1985, now abandoned.

BACKGROUND OF THE INVENTION

1. Field of the Invention

The present invention relates to a grain-oriented electrical steel sheet having a low watt loss. More particularly, the present invention relates to a grain-oriented electrical steel sheet, in which the magnetic domains are subdivided and the subdivision effect does not disappear, even if the steel sheet is subsequently heat treated. The present invention also relates to a method for producing the grain-oriented electrical steel sheet as mentioned above.

2. Description of the Related Art

The grain-oriented electrical steel sheet is used mainly as the core material of transformers and other electrical machinery and devices, and must, therefore, have excellent excitation and watt-loss characteristics. In the grain-oriented electrical steel sheet, secondary recrystallized grains are developed which have a (110) plane parallel to the rolled surface and a <001> axis parallel to the rolling direction. These grains have the so-called Goss texture formed by utilizing the secondary recrystallization phenomenon. Products having improved exciting and watt-loss characteristics can be produced by enhancing the orientation degree of the (110) <001> orientation and lessening the deviation of the <001> axis from the rolling direction.

Note, the enhancement of the (110) <001> orientation leads to a coarsening of the crystal grains and an enlargement of the magnetic domains due to a passing of domain walls through the grain boundaries. There occurs, accordingly, a phenomenon such that the watt loss cannot be lessened proportionally to enhance the orientation.

Japanese Examined Patent Publication No. 58-5968 proposes to lessen the watt loss by eliminating the non-proportional phenomenon regarding the relationship between the orientation enhancement and the watt loss-reduction. According to this proposal, a ball or the like is pressed against the surface of a finishing-annealed, grain-oriented sheet so as to form an indentation having depth of 5 $\mu$ or less. By this indentation, a linear, minute strain is imparted to the steel sheet, with the result that the magnetic domains are subdivided.

Japanese Examined Patent Publication No. 58-26410 proposes to form at least one mark on each of the secondary recrystallized crystal grains by means of laser-irradiation, thereby subdividing the magnetic domains and lessening the watt loss.

The materials having ultra-low watt loss can be obtained, according to the methods disclosed in the above Japanese Examined Patent Publication Nos. 59-5868 and 58-26410, by means of imparting a local minute strain to the sheet surface of a grain-oriented electrical steel sheet. Nevertheless, the watt loss-reduction effect attained in the above ultra-low watt loss materials disappears upon annealing, for example, during stress-relief annealing. For example, in the production of wound cores, the watt loss-reducing effect disappears disadvantageously after the stress-relief annealing.

It is also known that the watt loss can be lessened by refining the crystal grains. For example, Japanese Examined Patent Publication No. 59-20745 intends to lessen the watt loss by determining an average crystal-grain diameter in the range of from 1 to 6 mm.

It is also known to impart tensional force to a steel sheet to lessen the watt loss. The tensional force in the steel sheet can be generated by differing the coefficient of thermal expansion between the insulating coating and the steel sheets.

The above described refining of crystal grains and strain imparting would not attain a great reduction in watt loss.

SUMMARY OF THE INVENTION

The materials having an ultra-low watt loss can be obtained by the methods for subdividing the magnetic domains. When these materials are annealed, for example, stress-relief annealed, the watt loss-reduction effect disappears. It is, therefore, an object of the present invention to provide a grain-oriented electrical steel sheet having an extremely low watt loss, and to provide a method for forming subdivided magnetic domains, in such a manner that the watt loss-reducing effect does not disappear even during a heat treatment, for example, stress-relief annealing.

The present inventors conducted a number of experiments for producing, by the magnetic domain subdividing method, a grain-oriented electrical steel sheet which can exhibit an extremely low watt loss even after a heat treatment at a temperature of from 700 to 900° C.

In the experiments, the intruders, which were distinguished from the finishing-annealed, grain-oriented electrical steel sheets either in components or in structure, were penetrated by heat-treatment with the aid of strain. The intruders were an alloy layer, a reaction product of the superficial reaction, and the like, and the intruders were spaced from one another.

As a result of the experiments as described above, it was discovered that: the nuclei of magnetic domains are generated on both sides of the intruders; these nuclei cause the subdivision of magnetic domains when the steel sheet is magnetized and, hence, an extremely low watt loss is obtained; the effect of reducing the watt loss does not disappear even after the steel sheet is annealed, for example, stress-relief annealed; and, an extremely low watt loss is maintained.

The term "intruder" herein expresses clusters, grains, lines, or the like formed by an intrusion of an intrudable means deposited on a steel sheet so that said means intrude alone, or intrude in combination with a steel part, an insulating coating of a steel sheet, or the components of a heating atmosphere.

A preferred intruder is one formed by Sb metal, Sb alloy, Sb mixture, or Sb compound, alone or combined with the steel body of a grain-oriented electrical steel sheet. The intruder containing Sb can cause the subdivision of the magnetic domains and drastically lessen the watt loss.

The effect of watt loss-reduction by the Sb-containing intruder is outstanding, since it does not disappear during a later stress-relief annealing at a high temperature, for example, from 700 to 1000° C. The magnetic flux density of steel sheets having the Sb-containing intruders is high.

The term "intrudable means" or "the intrudable means for subdividing the magnetic domains" herein represents the material capable of forming the intruder, and more specifically, is the material intruded into the steel sheet due to heating.

Metals and nonmetals selected from the group of Al, Si, Bi, Sb, Sr, Cu, Sn, Zn, Fe, Ni, Cr, Mn, S, Zr, Mo, Co, as well as mixtures, oxides, and alloys thereof are used.

The term "film" herein collectively indicates a mechanical coated film, a chemically deposited film, e.g., a plating film, and a bonded film of the intrudable means; which films are formed on at least a part of the steel sheet. The term "film" may include partly a reaction layer and may have any thickness which is not specified in any way.

DESCRIPTION OF THE PREFERRED EMBODIMENTS

Figure 1:
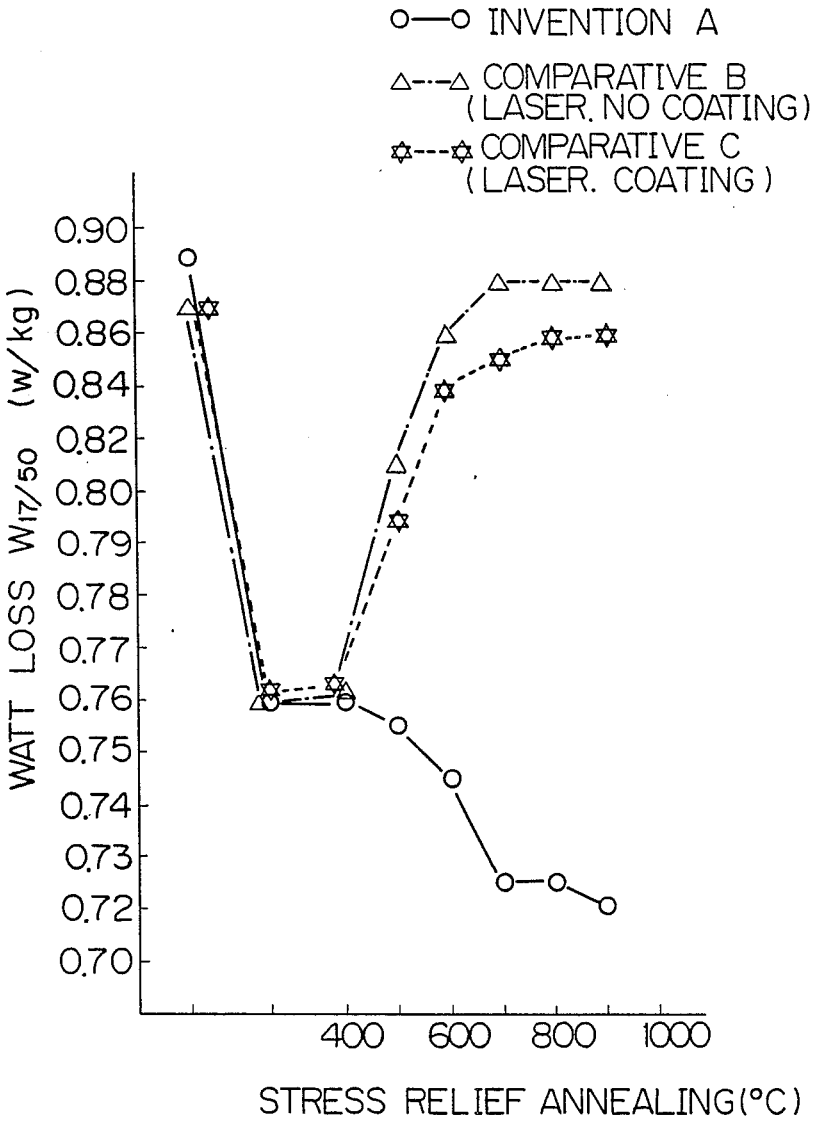
FIG. 1 shows the heat-resistance of the subdivided magnetic domains attained by the inventive and comparative methods.

FIG. 1 illustrates an experiment by the present inventors. The Si-steel slabs used in this experiment contained 3.20% of Si, 0.070% of Mn, 0.028% of Al, 0.021% of S, and 0.006% of Si. The Si-steel slabs were hot-rolled, annealed, and cold-rolled by a well known method. After the finishing annealing, minute strains were imparted to the grain-oriented electrical steel sheets by means of laser-irradiation, Sb as the intrudable means was then deposited on the regions having minute strain, and then heat treatment was applied to cause the penetration into the steel of intruders having a composition and structure distinguished from those of the steel part of the sheet; which sheet is hereinafter referred to as the grain-oriented electrical steel sheet A. The steel sheet hereinafter referred to as the grain-oriented electrical steel sheet B, was subjected only to the process of imparting minute strains, as described above. The steel sheet hereinafter referred to as the grain-oriented electrical steel sheet C, was subjected to the process of imparting minute strains as described above, and further, to the processes of applying a coating solution of an insulating film and baking to form an insulating coating. The grain-oriented electrical steel sheets A, B, and C were heat treated at a temperature of from 400 to 900° C, which corresponds to the temperature of the stress relief annealing. The magnetic properties were then measured and the obtained results were as shown in FIG. 1. As apparent from FIG. 1, the watt loss is not degraded and a low watt loss is attained in the grain-oriented electrical steel sheet A with the intruders. Conversely, in the grain-oriented electrical steel sheets B and C to which the minute strains are imparted and to which the minute strains are imparted followed by forming an insulating coating, respectively, the watt loss is degraded due to the stress relief annealing. In the grain-oriented electrical steel sheet C, substantially no insulating film was locally intruded into the steel sheet.

The heat-resistant subdivision of the magnetic domains can be performed as follows. Strain is imparted to the grain-oriented electrical steel sheet. The intrudable means in the form of metallic or nonmetallic powder, or metallic or nonmetallic oxide powder, is applied, on the finishing-annealed, grain-oriented electrical steel sheet, with spaced distances of the application. When the heat treatment is then carried out, the applied material (intrudable means) is caused to react with the steel sheet or the insulating coating and is forced into the steel sheet via the strain. The intruders having components or a structure different from those of steel therefore can be formed spaced from one another.

In accordance with the present invention there is provided a grain-oriented electrical steel sheet having an ultra low watt loss, characterized in that intruders, which are spaced from one another and are distinguished from the steel in component or in structure, are formed on or in the vicinity of the plastic strain region, thereby subdividing the magnetic domains.

There is also provided a method for producing a grain-oriented electrical steel sheet by steps including a subdivision of magnetic domains, characterized in that, a strain is imparted to the grain-oriented electrical steel sheet, and an intrudable means for forming the intruders being distinguished from the steel in component or structure, is formed on the grain-oriented electrical steel sheet prior to or subsequent to imparting of the strain.

Note, the technique disclosed in Japanese Examined Patent Publication No. 54-23647 is similar to the present invention in the point that a metal or compound is intruded into the steel sheet. It is proposed in this technique that, in order to refine the secondary recrystallized grains, before the finishing annealing the compound, metal, or element alone, which is rendered to slurry form, is applied on the steel sheet and is thermally diffused into the steel sheet thereby forming, before the finishing annealing, the secondary recrystallization-regions in the steel sheet. Principally speaking, this technique allegedly stops the growth of grains other than (110) ° 001>oriented grains at the secondary recrystallization regions, thereby attaining a preferential growth of the (110) <001> oriented grains. The watt loss $W_{17/50}$ attained in the Japanese Examined Patent Publication No. 54-23647 is approximately 1.00 W/kg which is considerably inferior to that which the present invention aims to attain. The present inventors believe that the watt loss according to the present invention is much less than that of the publication because diffusing metal and the like applied on the steel sheet at a step prior to the finishing annealing prevents the coarsening of grains to attain the watt loss reduction in Japanese Examined Patent Publication No. 54-23647, while, in the present invention, after completion of the secondary recrystallization, in order to subdivide the magnetic domains the intruder is forced into the steel sheet, in which the Goss texture is thoroughly developed.

Method for Applying an Intrudable Means

The grain-oriented electrical steel sheet, which is subjected to the subdivision of magnetic domains according to the present invention, may be produced by using any composition and under any conditions of production steps until the finishing annealing. That is, AlN, MnS, MnSe, BN, $Cu_2S$ and the like can be optionally used as the inhibitor. The Cu, Sn, Cr, Ni, Mo, Sb, W, and the like may be contained if necessary. The silicon steels containing the inhibitor elements are hot-rolled, annealed, and cold-rolled once or twice with an intermediate annealing to obtain the final sheet thickness, decarburization annealed, an annealing separator applied, and are finally finishing annealed.

The agent which is the intrudable means consists of at least one member selected from the metal- and nonmetal-group consisting of Al, Si, Bi, Sb, Sr, Cu, Sn, Zn, Ni, Cr, Mn, their oxides, alloys, as well as mixtures thereof. The agent is rendered to a slurry state or solution state and is applied linearly or spot-like on the finishing-annealed, grain-oriented electrical steel sheet. The lines are spaced from one another.

The metallic or nonmetallic powder has a size of tens of microns or less. In the slurry, the amount of metallic, nonmetallic, or oxide powder is preferably in a concentration from approximately 2 to 100 parts by weight relative to 100 parts by weight of water, since the slurry can be applied at a high efficiency at such a concentration. The metallic or nonmetallic powder or oxide can be mixed with acid or salt, which may be the stock solution or may be diluted with water.

Method for Imparting Strain

The intrudable means are applied on the finishing-annealed, grain-oriented electrical steel sheet to form a film having a weight of from approximately 0.1 to 50 $g/m^2$. The application of the intrudable means is carried out by plating, vapor-depositing, bonding, fusion-bonding, or the like, preferably by plating. Prior to or subsequent to the application of the intrudable means, the plastic strain is imparted by an optical means, such as laser irradiation, or a mechanical means, such as the grooved roll, ball point pen and marking-off methods. The regions of a grain-oriented electrical steel sheet to which the strain is imparted are spaced from one another.

The method for imparting the strain is more specifically described.

The intrudable means is applied on the grain-oriented electrical steel sheet with a space distance of from 3 to 30 mm. This grain-oriented electrical steel sheet is preliminarily subjected to a mechanical formation of minute indentations with a space distance of from 3 to 30 mm by means of a small ball, a ball point pen, marking-off, a grooved roll, a roller, or the like. Alternatively, the optical method may be used, such as laser irradiation, for forming the marks. The application amount of the intrudable means can be from 0.1 to 50 $g/m^2$, preferably from 0.3 to 10 $g/m^2$ of area of marks, flaws and the like, in terms of the weight of the intrudable means after the application and drying. Subsequently, the heat treatment is carried out at a temperature of from 500 to 1200° C, after drying the applied agent. During the heat treatment, the intrudable means is brought into reaction with the steel sheet and/or the insulating film and forced into the steel sheet along its width to form the intruders, such as the alloy layer and/or the surface-reaction product. The intruders so formed are spaced from one another. The insulating film herein is a forsterite film or insulating coating film containing colloidal silica, aluminum phosphate, magnesium phosphate, chromic acid anhydride, chromate, and the like, which is ordinarily formed on a grain-oriented electrical steel sheet.

Regarding the laser-irradiation method for imparting the strain, the laser may be any one of a $CO_2$ laser, $N_2$ laser, ruby laser, pulse laser, YAG laser, and the like. The space distance between the strain-imparted regions may be from 1 to 30 mm and these regions may be equi-distant or non-equidistant.

Figure 2:
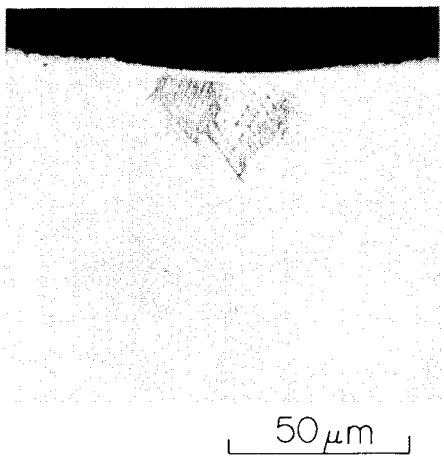
FIG. 2 is a photograph showing strain in the steel sheet.

The method for imparting the strain is not to subdivide the magnetic domains by itself, as in the conventional method, but to promote the intruder formation due to a stably enhanced reaction between the film and the steel sheet or between the film and the surface coating. The strain and intrudable means are further explained with reference to FIG. 2 showing the strain by black shadow. In this explanation, it is assumed that the heat treatment is not carried out by the steel maker but by the user. The intrudable means, such as the plated Sb, is merely deposited on the steel sheet and does not exert an effect upon the magnetic properties until the steel sheet is annealed by the user. Upon annealing, Sb diffuses into the steel sheet, precipitates in the steel sheet, and forms an intermetallic compound. The surface of a grain-oriented electrical steel sheet, to which the laser is applied, is influenced by the laser so that this surface and its proximity undergo plastic deformation (black shadow in FIG. 2). As a result of the plastic deformation, dislocations, vacancies and other defects increase in the crystal lattices of deformed region and its proximity. During the annealing, the restoration of the regions influenced by the laser is made in such a manner that polygonization occurs and subgrains form due to the rearranging of the dislocations. The grain boundaries of the subgrains and defects still remaining at the annealing facilitate the diffusion of the Sb into the steel. The diffused Sb forms an intermetallic compound at the grain boundaries of the subgrains and similar sites of crystals and the intermetallic compound is precipitated. Unless the defects remain as explained above, not only does the diffusion occur at a slow rate but also a uniform diffusion occurs such that Sb penetrates into the steel in all directions. In the diffusion under the utilization of regions influenced by the plastic deformation, the diffusion rate is high and the diffusion does not spread unlimitedly but is limited to occur only in the regions mentioned above. Accordingly, the Sb can penetrate into the steel sheet to a depth of, for example, from 5 to 30 μm, and form a distinct phase which is highly effective for subdividing the magnetic domains.

The method for imparting the strain is described more specifically.

The degree of strain is appropriately determined depending upon the kind of agents used, the temperature-elevating rate and holding-temperature of heat treatment, and the like. The strain-imparting by the laser irradiation can be carried out at an energy density of from 0.05 to 10 $J/cm^2$. The strain-imparting by marking-off can be carried out at a depth of 5 μm or less. According to the discoveries made by the present inventors during their research into conventional methods of subdividing the magnetic domains by imparting strain, the effect of subdividing the magnetic domains can be made to disappear by holding the temperature at 700–900° C. for a few hours. It is therefore believed that the stress induced by strain decreases at a temperature of from 700 to 900° C. On the other hand, such a temperature range promotes the formation of intruders in the method utilizing the imparted strain according to the present invention. It is therefore believed that, prior to the disappearance of the stress induced by strain, the material of a film actively propagates into the steel sheet. The temperature-elevating rate and the holding time and temperature can therefore be advantageously determined so that the stress induced by strain does not disappear during the active propagation. The appropriate temperature-elevating rate and the holding time and temperature, as well as their appropriate ranges for stably forming the intruder, are dependent upon the component or kind of film, the concentration of agent in the film, and the like.

Figure 3:
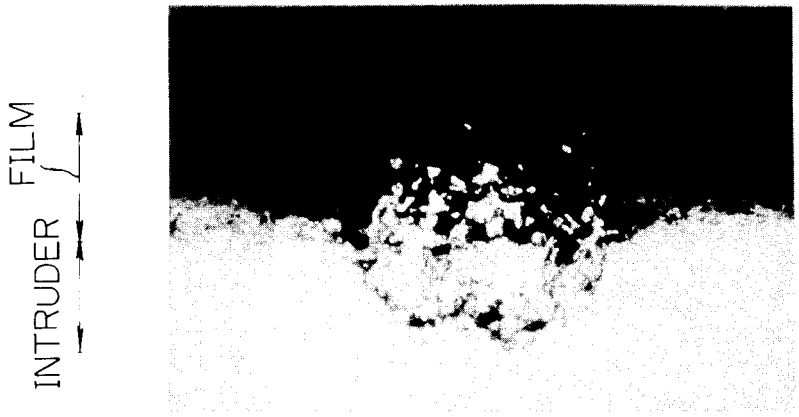
FIG. 3 is an optical microscope photograph showing an example of the intruder.

Referring to FIG. 3, the intruder is shown. The intruder was formed by utilizing the stress generated by a marking off method. As is apparent from FIG. 3, which is a microscope photograph at the magnification of 1,000, the intruder sharply penetrates into the steel sheet along its width.

Note that the laser irradiation can be carried out after application of the intrudable means, which may be made as either an entire or partial formation of the intrudable means on the finishing annealed, grain-oriented electrical steel sheet. Also in this case, the strain, which is imparted to the intrudable means, contributes to a stable formation of the intruder when the subsequent heat treatment is carried out, since the strain enhances the reactions of the intrudable means with the surface coating and steel sheet during the temperature-elevation and holding. However, the strain-imparting causes the destruction of a film in many cases. Such destruction can be prevented by a thick application of the agent or by strengthening the film by, for example, a heat treatment at approximately 500° C.

Plating Method

A glass film, oxide film, and occasionally an insulating coating (surface coating), are formed on the finishing annealed, grain-oriented electrical steel sheet. These films and coating can be removed entirely or with a space distance by laser-irradiating, grinding, machining, scarfing, chemical polishing, pickling, shot-blasting or the like, to expose the steel part of the grain-oriented electrical steel sheet. The intrudable means, such as metal, nonmetal, a mixture thereof, alloy, and oxide thereof are plated on the steel sheet. When the glass film and the like are removed with a space distance, an electroplating, a hot dipping, or the like is employed for plating. When the glass film and the like are removed entirely, a partial electroplating is employed for plating. The building up amount is 0.1 $g/m^2$ or more.

The deposited intrudable means is readily bonded with the steel part of a grain-oriented electrical steel sheet, and a part of the intrudable means may form a film of alloy. When subjected to the subsequent heat treatment, the intruders spaced from one another are formed in an extremely short period of time.

The oxide film mentioned above is formed during the decarburization annealing and is mainly composed of $SiO_2$. The glass film is formed by a reaction between the oxide film and the annealing separator mainly composed of MgO and is also referred to as the forstellite film. The insulating coating mentioned above is formed by applying colloidal silica, chromic acid anhydride, aluminum phosphate, magnesium phosphate, and the like on the steel sheet and then baking them. The oxide film, glass film and the insulating coating suppresses the intrusion of an intrudable means. By removing such oxide film and the like, the reactivity between the intrudable means and the steel part of the grain-oriented electrical steel sheet is enhanced. Since the intrusion depth and amount can be easily changed by controlling the building up amount, it becomes also possible to distinguishably produce products having different grades of watt loss characteristics by controlling the building up amount. In addition, due to an enhanced reactivity, the heat treatment after plating in the steel maker may be omitted, but carried out if necessary to increase the intrusion depth and amount.

The spaced removal of the insulating film can be carried out by laser-irradiation, grinding, shot-blasting machining, scarfing, local pickling and the like. The removed regions are spaced from one another by the distance of 1 mm or more, preferably from 1–30 mm, with an equal or nonequal distance, and are oriented preferably at an angle of from 30 to 90 degrees relative to the rolling direction of steel sheet. The removal operation may be continuous, with the aid of pickling or shot-blasting, or discontinuous. The width of each of the removed regions is preferably from 0.01 to 5 mm in the light of an effective formation of the intruder. The steel body of a grain-oriented electrical steel sheet is exposed by removing the oxide film and the like. During this exposure, the steel body is partly slightly recessed and the strain is imparted simultaneously with the recess formation.

After the removal as described above, the electroplating of an intrudable means is carried out.

In a case of the spaced removal of the insulating film, the steel sheet is conveyed, for the electroplating, through the electrolytic solution, into which is incorporated an intrudable means. An electro-chemical reaction occurs, during the electroplating, only where the surface coating is removed with a distance and the steel body of a steel sheet is thus exposed. The intrudable means is therefore electroplated on only portions of the steel sheet where the steel body is exposed, and the other portions are not electroplated with the intrudable means. The non-reaction of the remaining insulating film with the plating solution also brings about an advantage in that a beautiful appearance of the surface coating is maintained.

Figure 4A:
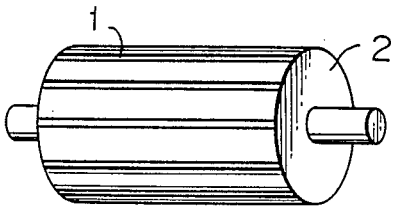
FIGS. 4(*a*) and (*b*) are an elevational view and lateral view, respectively, of an electric plating apparatus.
Figure 4B:
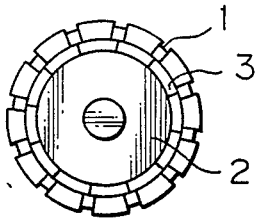

In the case of an entire removal of the insulating film, the partial electroplating is employed for plating the intrudable means with a space distance, as described with reference to FIG. 4. The electroplating roll shown in FIG. 4 is provided with conductive zones 1, which are spaced from one another. In the roll body, a passage 2 for the electrolyte solution is formed. Injection apertures 3 for the electrolyte solution are formed through the conductive zones 1 or in their neighbourhood. By varying the distance between and arrangement of the conductive zones 1, the distance between and arrangement of the plated metals also can be varied. The electrolyte solution, into which the intrudable means is incorporated as described above, is also used for the partial electroplating, and the portions of a steel sheet through which the current is conducted are plated with the intrudable means and the intruder is formed in such portions. The width of each of the portions mentioned above is preferably from 0.01 to 5 mm.

In the plating method, the building up amount is important, since, at a small ineffective amount, the amount of intruder formed is too small to subdivide the magnetic domains. At a building up amount of 0.1 $g/m^2$ or more, a heat-resistant subdivision of the magnetic domains can be achieved. In addition, by controlling the building up amount, the intrusion depth and amount can be varied. For example, by increasing the building up amount, the intrusion depth and amount can be increased and the watt loss characteristics can thus be greatly improved and, further, the products having different grades of watt loss characteristics can be distinguishably produced.

Sb-based Intrudable Means and Plating Method

According to a preferred method for locating the intrudable means on the finishing-annealed, grain-oriented electrical steel sheet, one or more members selected from the group consisting of Sb alone, Sb-Sn, Sb-Zn, Sb-Pb, Sb-Bi, Sb-Sn-Zn, Sb-Co, Sb-Ni, other Sb alloys, a mixture of Sb with one or more of Sn, Zn, Pb, Bi, Co, Ni, Al and the like, Sb oxide, Sb sulfate, Sb borate, and other Sb compounds are incorporated into the electrolyte solution, through which a steel sheet is conveyed for electroplating. In a preferred electroplating method, the plating bath is a fluoride bath or borofluoride bath which contains fluoric acid, borofluoric acid, boric acid, and further selectively contains sodium sulfate, salt (NaCl), ammonium chloride, and caustic soda. A preferred building up amount is 1 $g/m^2$ or more.

Figure 5:
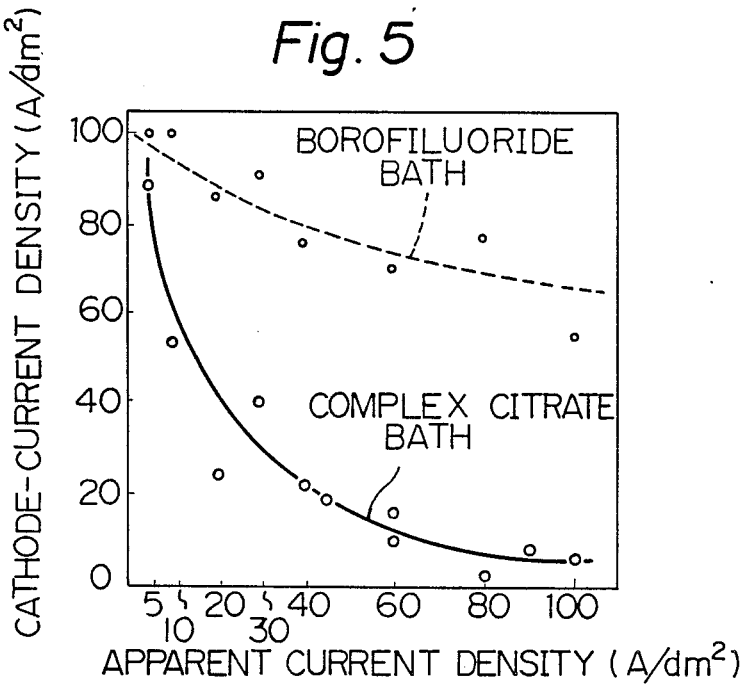
FIG. 5 is a graph showing the relationship between the current density and cathode-current density in an electroplating.

By means of plating with the fluoride bath or borofluoride bath, a distinctly crystalline electro-deposition is obtained at a high current efficiency, the density of which current, as shown in FIG. 5, ranges from a low to a high value. The electrolyte solution used in the electroplating solution is a borofluoride bath which consists of borofluoric acid, and boric acid, and Sb.

The 0.23 mm thick and 914 mm wide grain-oriented electrical steel sheet is subjected to removal of a glass film and an insulating coating with a space distance of 5 mm and width of 0.2 mm. The samples obtained from the steel sheet are then conveyed through the electrolyte solution, while varying the current density. The relationship between the apparent current density and cathode current efficiency is shown in FIG. 5. For comparison purposes, the electrolyte solution containing a complex citrate is used for the electroplating.

As is apparent from FIG. 5, the precipitation efficiency of the intrudable means is high, and the stability of the precipitation is high, at a high current density.

Effects similar to this are attained by using a fluoride bath for the electroplating.

The borofluoride bath and fluoride bath also can be used for electroplating Sn, Zn, Fe, Ni, Cr, Mn, Mo, Co and their alloys. The borofluoride bath contains borofluoric acid, boric acid, and in addition, one or more of the conductive salts.

The borofluoride bath and fluoride bath are advantageous over other baths, such as the sulfate-, chloride-, and organic salt-baths, in the points as explained with reference to FIG. 5. The former baths can therefore attain a low watt loss at a low metal-deposition amount as compared with the latter baths, possibly because for the following reasons. Generally speaking, when the glass film and the like of a grain-oriented electrical steel sheet is subjected to the removal by laser-irradiating, grinding, machining, shot-blasting, and the like, part of the glass film and the like are usually left on the steel sheet. The unremoved film occasionally impedes during plating of an intrudable means, the forcing of the intrudable means satisfactorily into the steel sheet. Hydrofluoric acid (HF) as a component of the fluoride bath etches vigorously the steel base and slightly dissolves the insulating film. Borofluoric acid ($HBF_4$) as a component of the borofluoride bath is believed to decompose in the bath and partially generates the hydrofluoric acid (HF) according to the following formula.

$$HBF_4 + 3H_2O \rightarrow 4HF + H_3BO_3$$

In the fluoride bath and borofluoride bath, the general nature of hydrofluoric acid can be advantageously used for dissolving the surface coating which partially remains due to a failure of complete removal by the laser irradiation and the like, and also for etching the steel base. The metal precipitated in the electroplating process can be firmly deposited on the steel sheet and can be brought into direct contact with the steel base via a broad contact area. An improved watt loss can therefore be attained at a small deposition amount of metal.

Typical watt loss values $W_{13/50}$ and $W_{17/15}$ and magnetic flux density attained by the present invention are shown in the following table.

TABLE 1

| | Magnetic Properties | Sheet Thickness (mm) 0.18 | 0.20 | 0.23 | 0.27 | 0.30 |
|---|---|---|---|---|---|---|
| Plated Material | $W_{13/50}$ (W/kg) | 0.33 | 0.37 | 0.40 | 0.45 | 0.51 |
| | $W_{17/50}$ (W/kg) | 0.64 | 0.67 | 0.69 | 0.80 | 0.87 |
| | $B_{10}$ (T) | 1.91 | 1.92 | 1.93 | 1.94 | 1.94 |
| Conventional Material (without plating) | $W_{13/50}$ (W/kg) | 0.40 | 0.45 | 0.47 | 0.52 | 0.61 |
| | $W_{17/50}$ (W/kg) | 0.80 | 0.84 | 0.88 | 0.94 | 0.98 |
| | $B_{10}$ (T) | 1.92 | 1.92 | 1.94 | 1.94 | 1.95 |

Figure 6:
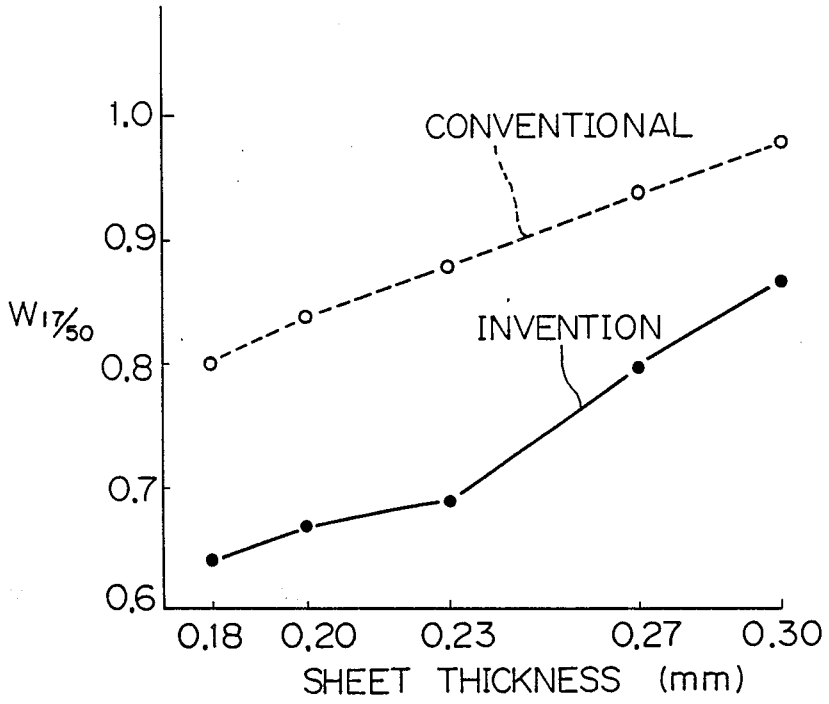
FIG. 6 is a graph showing the relationship between the sheet thickness and watt loss.

The relationships between the $W_{17/50}$ and the sheet thickness are shown in FIG. 6, in which the solid and chain lines indicate the Sb plated material and conventional materials, respectively, of Table 1. Note that the grain-oriented electrical steel sheet having $W_{17/50}$ dependent upon sheet thickness essentially coincident with "INVENTION" is considerably improved over the conventional material.

In the case of the borofluoride bath and fluoride bath, the building up amount is also important as described hereinabove. A preferred building up amount is 1 $g/m^2$ or more.

It is another outstanding feature of the borofluoride bath and fluoride bath that the intruder is effectively formed upon heat treatment, in an extremely short period of time, namely at a high productivity, and further, the surface appearance of the steel sheets is excellent.

Zn is another preferred intrudable means. After the Zn plating, metal having a vapor pressure lower than that of Zn is preferably plated on the Zn, and subsequently, the plating is preferably carried out in an electrolyte solution containing one or more of Ni, Co, Cr, Cu, and their alloys.

In a case of using the citric acid bath, such an efficient plating as in the case of using the borofluoride bath can be attained by preliminarily light pickling prior to the plating.

Heat Treatment Method

During the heat treatment at a temperature of from 500 to 1200° C, a reaction between the intrudable means and steel part or insulating film of a grain-oriented electrical steel sheet is advanced. This reaction is activated by the strain in the temperature-elevating stage or holding stage of the heat treatment. The intruders are formed so that they are forced with a space therebetween, into the steel part and are structurally distinguished from the secondarily recrystallized structure having Goss orientation or are distinguished from the composition of the steel body. The heat treatment is carried out in a neutral atmosphere or a reducing atmosphere containing $H_2$. The intruder can be an aggregate of the spot-form materials.

As described above, the temperature-elevating rate and holding temperature are preferably determined depending upon the kind of intrudable means. This is because, during the intruding procedure, the intrusion depth and amount are influenced by thermal and diffusion conditions. The intrusion depth and amount appears to be influenced by whether or not the film thermally firmly adheres to the steel sheet prior to initiation of the intrusion. Since the effect of improving the watt loss characteristics becomes generally great with an increase in the depth of an intruder measured from the steel base surface of a grain-oriented electrical steel sheet, the above described influences should be desirably used for forming deep intruders. When the temperature-elevating rate is too slow, the amount of intruder formed becomes small and the total heat treatment-time becomes long. On the other hand, when the temperature-elevating rate is too high, there is a danger, especially for the intrudable means having a low melting point, that the intrudable means are lost due to vaporization or the like before completion of a satisfactory reaction with the surface coating and steel base of a grain-oriented electrical steel sheet. When the holding temperature is too low, the reaction of the intrudable means becomes unsatisfactory. On the other hand, if the holding temperature is too high, the electrical insulating property of the insulating coating is impaired, the heat energy is consumed undesirably, and a failure in the shape of the steel sheets occurs. Generally, the holding temperature should be in the range of from 500 to 1,200° C. The kinds of intrudable means should be appropriately selected depending upon the temperature elevating rate and holding temperature selected within these ranges. The heat treatment for forming the intruders may be carried out also for stress relief.

Film Recoating Method

After the formation of the intrudable means, the solution for the insulating coating can be applied on the grain-oriented electrical steel sheet and baked at a temperature of, preferably 350° C. or more. The solution for the insulating coating, for example, can contain at least one member selected from the group consisting of phosphoric acid, phosphate, chromic acid, chromate, bichromate, and colloidal silica.

The plated intrudable means do not peel off the steel sheets during handling due to coil slip and do not vaporize during the annealing, since the plated intrudable means are covered with the insulating coating. The formation of intruders can therefore be further stabilized. In addition, the corrosion resistance and insulating property of portions of the steel sheets where intruders are formed are improved by the insulating coating.

Depth of Intruder

Samples having various intruder depths were prepared by varying the temperature and time of the heat treatment. The composition of the slabs, from which the 0.225 mm thick grain-oriented electrical steel sheets were manufactured by well known steps starting at the slab heating and ending at the finishing annealing, was as follows.

C: 0.05–0.08%, Si: 2.95–3.33%, Mn: 0.04–0.12%, Al: 0.010–0.050%, S: 0.02–0.03%, N: 0.0060–0.0090%.

The depth of grains or clusters forced into the steel sheet was measured. The watt loss $W_{17/50}$ after the finishing annealing ($W^1_{17/50}$) and the watt loss $W_{17/50}$ after the formation of the intruder ($W^2_{17/50}$) were measured and the watt loss-improving percentage ($\Delta W$) was calculated as follows.

$$\Delta W = \{(W^1_{17/50} - W^2_{17/50})/W^1_{17/50}\} \times 100(\%)$$

Figure 7:
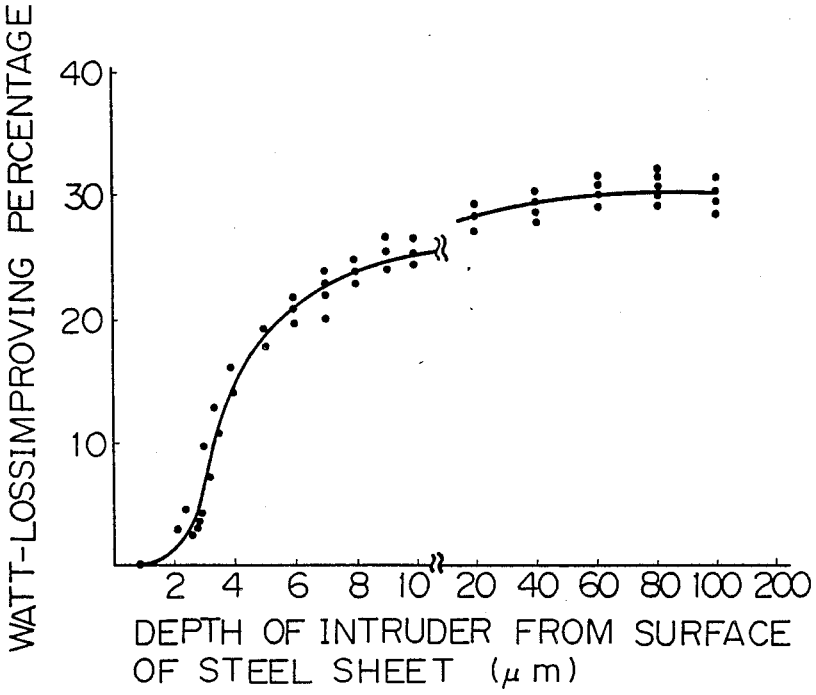
FIG. 7 is a graph showing a relationship between the depth of intruder and the reduction percentage in watt loss.

The influence of the depth of the intruders measured from the surface of steel body of grain-oriented electrical steel sheets upon the watt-loss improving percentage ($\Delta W$) was investigated. The results are shown in FIG. 7. As is apparent from FIG. 7, an appreciable improvement in terms of $\Delta W$ is obtained at an intruder depth of 2 μm or more, and this improvement is enhanced with an increase in the intruder depth. The improvement in terms of $\Delta W$ saturates at an intruder depth of approximately 100 μm. Such a relationship as described above can be found not only in the steel composition of the above samples but also in the steel compositions containing one or more of Cu, Sn, Sb, Mo, Cr, Ni and the like. A preferred depth of the intruders according to the present invention is 2 μm or more. The maximum intruder depth is not specifically limited but is determined by taking into consideration the thickness of the steel sheets and the like. Although the intruder depth should be specified as described above, the distances therebetween need not be specified at all, and may be, for example, from approximately 1 to 30 mm. When the space distance between the intruders is determined narrowly, the grains, clusters and the like of the intruders appear virtually continuous.

The present invention is now explained with reference to examples.

EXAMPLE 1

Silicon steel slabs, which consisted of 0.077% of C, 3.28% of Si, 0.076% of Mn, 0.030% of Al, 0.024% of S, 0.15% of Cu, 0.15% of Sn and iron essentially in balance were subjected to well known steps for producing a grain-oriented electrical steel sheet of hot-rolling, annealing, and cold-rolling. The 0.250 mm thick cold-rolled steel sheets were obtained. Subsequently, the well known steps of decarburization annealing, application of annealing separator and finishing annealing were carried out.

The finishing annealed coils were subjected to application of an insulating coating and heat-flattening. Samples of 10 cm in width and 50 cm in length were cut from these coils and irradiated with laser to form minor flaws which extended perpendicular to the rolling direction and were spaced from one another by a distance of 10 mm, as seen in the rolling direction. These samples are denoted as "before treatment".

Subsequent to the laser irradiation, the agent A (ZnO: 10 g+Sn: 5 g), the agent B ($Sb_2O_3$: 10 g+$H_3BO_3$: 10 g), the agent C (Sb: 10 g+$SrSO_4$: 20 g), and the agent D (Cu: 10 g+$Na_2B_4O_7$: 20 g) were respectively applied on the samples in an amount of 0.5 g/m$^2$ in terms of weight after application and drying. The samples were then laminated one upon another and dried at a furnace temperature of 400° C. The samples were then heat treated at 800° C for 30 minutes. The samples subjected to this heat treatment are denoted as "after treatment". The samples were further subjected to a stress-relief annealing at 800° C for 2 hours. These samples are denoted as "after stress-relief annealing". The magnetic properties of the samples before and after treatment and after stress relief annealing were measured. The measurement results are shown in Table 2.

TABLE 2

| Agent | Magnetic Properties: Before treatment (After laser-irradiation) $B_{10}$ (T) | $W_{17/50}$ (W/kg) | After treatment (800° C. × 30 minutes, baking) $B_{10}$ (T) | $W_{17/50}$ (W/kg) | After stress-relief annealing (800° C. × 2 hours) $B_{10}$ (T) | $W_{17/50}$ (W/kg) |
|---|---|---|---|---|---|---|
| A | 1.925 | 0.79 | 1.926 | 0.80 | 1.926 | 0.80 |
| B | 1.928 | 0.76 | 1.929 | 0.77 | 1.930 | 0.77 |
| C | 1.923 | 0.75 | 1.923 | 0.75 | 1.923 | 0.75 |
| D | 1.931 | 0.78 | 1.932 | 0.78 | 1.933 | 0.79 |
| E (non-application of agent, comparative example) | 1.928 | 0.76 | — | — | 1.935 | 0.89 |

EXAMPLE 2

Silicon steel slabs, which consisted of 0.077% of C, 3.30% of Si, 0.076% of Mn, 0.028% of Al, 0.024% of S, 0.16% of Cu, 0.12% of Sn and iron essentially in balance, were subjected to well known steps for producing a grain-oriented electrical steel sheet of hot-rolling, annealing, and cold rolling. The 0.225 mm thick cold-rolled steel sheets were obtained. Subsequently, the well known steps of decarburization annealing, application of annealing separator and finishing annealing were carried out. The finishing annealed coils were subjected to application of an insulating coating and heat-flattening. Samples of 10 cm in width and 50 cm in length were cut from these coils and then marked-off to impart the strain which extended perpendicular to the rolling direction and were spaced from one another by a distance of 10 mm. These samples are denoted as "before treatment".

Subsequent to the marking-off, the $Sb_2O_3$ powder in the powder form, as the agent, was rendered to a slurry containing the powder in an amount of 10 g/$H_2O$-50 cc. The slurry was applied on the samples in an amount of 0.6 g/m$^2$ in terms of weight after application and drying. After drying the heat treatment was carried out while varying the conditions in a temperature ranging from 800 to 900° C and a time ranging from 5 to 120 minutes so as to vary the intruding depth of the intruder. The samples subjected to this heat treatment are denoted as "after treatment". The samples were further subjected to a stress-relief annealing at 800° C. for 2 hours. These samples are denoted as "after stress-relief annealing". The magnetic properties of the samples before and after treatment and after stress relief annealing were measured. The measurement results are shown in Table 3.

TABLE 3

| Depth of Intruder (μ) | Magnetic Properties: Before treatment (After laser-irradiation) $B_{10}$ (T) | $W_{17/50}$ (W/kg) | After treatment $B_{10}$ (T) | $W_{17/50}$ (W/kg) | After stress-relief annealing $B_{10}$ (T) | $W_{17/50}$ (W/kg) |
|---|---|---|---|---|---|---|
| 2~3 | 1.930 | 0.78 | 1.923 | 0.78 | 1.920 | 0.76 |
| 5~7 | 1.928 | 0.76 | 1.918 | 0.75 | 1.913 | 0.73 |
| 10~12 | 1.933 | 0.74 | 1.915 | 0.72 | 1.908 | 0.69 |
| 30~34 | 1.930 | 0.77 | 1.905 | 0.75 | 1.899 | 0.69 |

EXAMPLE 3

Silicon steel slabs, which consisted of 0.077% of C, 3.30% of Si, 0.076% of Mn, 0.032% of Al, 0.024% of S, 0.16% of Cu, 0.18% of Sn and iron essentially in balance, were subjected to well known steps for producing a grain-oriented electrical steel sheet of hot-rolling, annealing, and cold rolling. The 0.225 mm thick cold-rolled steel sheets were obtained. Subsequently, the well known steps of decarburization annealing, application of annealing separator and finishing annealing were carried out.

The finishing annealed coils were subjected to application of an insulating coating and heat-flattening. Samples of 10 cm in width and 50 cm in length were cut from these coils and irradiated with laser to form minor strain which extended perpendicular to the rolling direction and were spaced from one another by a distance of 10 mm, as seen in the rolling direction. These samples are denoted as "before treatment".

Subsequent to the laser irradiation, the agent A (ZnO: 10 g+Sn: 5 g), the agent B ($Sb_2O_3$: 10 g+ $H_3BO_3$: 10 g), the agent C (Sb: 10 g+$SrSO_4$: 20 g), and the agent D (Cu: 10 g+$Na_2B_4O_7$: 20 g) were respectively applied on the entire surface of samples in an amount of 0.5 g/m$^2$ in terms of weight after application and drying. The samples were dried at a furnace temperature of 400° C., laminated upon one another, and heat-treated at 800° C. for 30 minutes. The samples subjected to this heat treatment are denoted as "after treatment". The samples were further subjected to a stress-relief annealing at 800° C. for 2 hours. These samples are denoted as "after stress-relief annealing". The magnetic properties of the samples before and after treatment and after stress relief annealing were measured. The measurement resulted are shown in Table 4.

TABLE 4

| Agent | Magnetic Properties: Before treatment (After laser-irradiation) $B_{10}$ (T) | $W_{17/50}$ (W/kg) | After treatment (800° C. × 30 minutes, baking) $B_{10}$ (T) | $W_{17/50}$ (W/kg) | After stress-relief annealing (800° C. × 2 hours) $B_{10}$ (T) | $W_{17/50}$ (W/kg) |
|---|---|---|---|---|---|---|
| A | 1.940 | 0.77 | 1.937 | 0.73 | 1.921 | 0.73 |
| B | 1.935 | 0.78 | 1.925 | 0.80 | 1.920 | 0.69 |
| C | 1.930 | 0.77 | 1.920 | 0.76 | 1.905 | 0.72 |
| D | 1.935 | 0.75 | 1.935 | 0.71 | 1.933 | 0.72 |
| E (non-application of agent, comparative example) | 1.932 | 0.78 | — | — | 1.932 | 0.91 |

EXAMPLE 4

Silicon steel slabs, which consisted of 0.078% of C, 3.25% of Si, 0.068% of Mn, 0.026% of Al, 0.024% of S, 0.15% of Cu, 0.08% of Sn and iron essentially in balance, were subjected to well known steps for producing a grain-oriented electrical steel sheet of hot-rolling, annealing, and cold rolling. The 0.225 mm thick cold-rolled steel sheets were obtained. Subsequently, the well known steps of decarburization annealing, application of annealing separator mainly composed of MgO and finishing annealing were carried out. The samples obtained from the steel sheets, which were subjected to the finishing annealing are denoted as "before treatment".

The steel sheet were irradiated with C02 laser in a direction virtually perpendicular to the rolling direction and with a distance space of 5 mm, so as to remove the glass film and oxide film. The steel sheets were then subjected to an electroplating using electrolyte solutions Nos. 1–5 containing, as plating metals, Sb (No. 1), Mn (No. 2), Cr (No. 3), Ni (No. 4), and none (No. 5), so as to deposit the intrudable means (plating metal) in a building up amount of 1 g/m$^2$. The samples obtained from the so treated steel sheets are denoted as "after treatment". The steel sheets were further subjected to a stress-relief annealing at 800° C. for 2 hours. The samples obtained from the so annealed steel sheets are denoted as "after stress-relief annealing". The magnetic properties of the samples before and after treatment and after stress relief annealing were measured. The measurement results are shown in Table 6.

TABLE 6

| | Magnetic Properties | | | | | |
|---|---|---|---|---|---|---|
| | Before treatment | | After treatment | | After stress-relief annealing (800° C. × 2 hours) | |
| Electrolyte Solution Nos. | $B_{10}$ (T) | $W_{17/50}$ (W/kg) | $B_{10}$ (T) | $W_{17/50}$ (W/kg) | $B_{10}$ (T) | $W_{17/50}$ (W/kg) |
| 1 | 1.938 | 0.82 | 1.937 | 0.80 | 1.940 | 0.78 |
| 2 | 1.940 | 0.84 | 1.938 | 0.81 | 1.943 | 0.74 |
| 3 | 1.935 | 0.82 | 1.936 | 0.79 | 1.940 | 0.75 |
| 4 | 1.948 | 0.81 | 1.947 | 0.80 | 1.949 | 0.76 |
| 5 (non-application of agent, comparative example) | 1.940 | 0.83 | — | — | 1.945 | 0.97 |

EXAMPLE 5

Silicon steel slabs, which consisted of 0.078% of C, 3.25% of Si, 0.068% of Mn, 0.026% of Al, 0.024% of S, 0.15% of Cu, 0.08% of Sn and iron essentially in balance, were subjected to well known steps for producing a grain-oriented electrical steel sheet of hot-rolling, annealing, and cold rolling. The 0.225 mm thick cold-rolled steel sheets were obtained. Subsequently, the well known steps of decarburization annealing, application of annealing separator mainly composed of MgO and finishing annealing were carried out. The samples obtained from the steel sheets, which were subjected to the finishing annealing are denoted as "before treatment".

The steel sheets were irradiated with $CO_2$ laser in a direction virtually perpendicular to the rolling direction and with a distance space of 10 mm, as seen in the rolling direction, so as to remove the glass film and oxide film. The steel sheets were then subjected to an electric plating using the electrolyte solution Nos. 1–5 containing Sb (No. 1), Zn (No. 2), Cr (No. 3), Sn (No. 4), and none (No. 5, comparative example), so as to deposit the intrudable means (plating metal) in a building up amount of 1 g/m2 The solution containing for insulating coating, containing aluminum phosphate, phosphoric acid, chromic acid anhydride, chromate, and colloidal silica was then applied on the surface of steel sheets and baked at 850° C to form an insulating coating. The samples obtained from the steel sheets with insulative coating are denoted as "after treatment".

The steel sheets were further subjected to a stress-relief annealing at 800° C for 2 hours. These samples are denoted as "after stress-relief annealing". The magnetic properties of the samples before and after treatment and after stress relief annealing were measured. The measurement results are shown in Table 7.

TABLE 7

| | Magnetic Properties | | | | | |
|---|---|---|---|---|---|---|
| | Before treatment | | After treatment | | After stress-relief annealing (800° C. × 2 hours) | |
| Electrolyte Solution Nos. | $B_{10}$ (T) | $W_{17/50}$ (W/kg) | $B_{10}$ (T) | $W_{17/50}$ (W/kg) | $B_{10}$ (T) | $W_{17/50}$ (W/kg) |
| 1 | 1.943 | 0.97 | 1.939 | 0.90 | 1.936 | 0.87 |
| 2 | 1.942 | 0.98 | 1.940 | 0.92 | 1.938 | 0.92 |
| 3 | 1.945 | 0.96 | 1.940 | 0.91 | 1.940 | 0.90 |
| 4 | 1.950 | 0.96 | 1.943 | 0.90 | 1.946 | 0.89 |
| 5 (non-application of agent, comparative example) | 1.946 | 0.98 | — | — | 1.947 | 0.98 |

EXAMPLE 6

Silicon steel slabs, which consisted of 0.080% of C, 3.30% of Si, 0.070% of Mn, 0.028% of Al, 0.025% of S, 0.0080% of N and iron essentially in balance were subjected to well known steps for producing a grain-oriented electrical steel sheet of hot-rolling, annealing, and cold-rolling. The 0.225 mm thick cold-rolled steel sheets were obtained. Subsequently, the well known steps of decarburization annealing, application of annealing separator mainly composed of MgO and finishing annealing were carried out. Solution for forming insulating coating was then applied on the finishing-annealed steel sheets and baked. During the baking, the heat-flattening annealing was also performed. The samples obtained from the steel sheets with the insulating coating, are denoted as "before treatment". These steel sheets were irradiated with $Co_2$ laser in a direction virtually perpendicular to the rolling direction and with a space distance of 5 mm, so as to remove the glass film and the insulating coating. The steel sheets were then subjected to an electric plating using the electrolyte solutions given in Table 8 and containing the intrudable means. The building up amount of the electric plating was from 0.05 to 10 g/m$^2$. The solution for insulating coating aluminum phosphate, chromic oxide anhydride, and colloidal silica was then applied on the steel sheets and baked at 350° C to form the insulating coating. The samples obtained from the steel sheets with an insulative coating are denoted as "after treatment". The steel sheets were further subjected to a stress-relief annealing at 800° C for 2 hours. The samples obtained from these steel sheets are denoted as "after stress-relief annealing". The magnetic properties of the samples before and after treatment and after stress relief annealing were measured. The measurement results are shown in Table 9.

TABLE 8

| Electrolyte Solution No. | Kind of Plated Metal | Building up Amount (g/m$^2$) |
|---|---|---|
| 1 (1) | Sb | 0.05 |
| (2) | " | 1.00 |
| (3) | " | 10.00 |
| 2 (1) | Mo | 0.05 |
| (2) | " | 1.00 |
| (3) | " | 10.00 |
| 3 (1) | Cu | 0.05 |
| (2) | " | 1.00 |

TABLE 8-continued

| Electrolyte Solution No. | Kind of Plated Metal | Building up Amount ($g/m^2$) |
|---|---|---|
| (3) | " | 10.00 |
| 4 (1) | Sb + Zn | 0.05 |
| (2) | " | 1.00 |
| (3) | " | 10.00 |
| 5 | Non-application of agent (comparative example) | — |

TABLE 9

| | Magnetic Properties | | | | | |
|---|---|---|---|---|---|---|
| | Before treatment | | After treatment | | After stress-relief annealing (800° C. × 2 H) | |
| Electrolyte Solution No. | $B_{10}$ (T) | $W_{17/50}$ (W/kg) | $B_{10}$ (T) | $W_{17/50}$ (W/kg) | $B_{10}$ (T) | $W_{17/50}$ (W/kg) |
| 1 (1) | 1.946 | 0.89 | 1.942 | 0.76 | 1.945 | 0.78 |
| (2) | 1.938 | 0.92 | 1.935 | 0.77 | 1.925 | 0.74 |
| (3) | 1 952 | 0.89 | 1.946 | 0.75 | 1.935 | 0.71 |
| 2 (1) | 1.951 | 0.88 | 1.946 | 0.79 | 1.948 | 0.81 |
| (2) | 1.950 | 0.90 | 1.945 | 0.76 | 1.940 | 0.75 |
| (3) | 1.939 | 0.93 | 1.936 | 0.78 | 1.925 | 0.73 |
| 3 (1) | 1.940 | 0.91 | 1.933 | 0.78 | 1.938 | 0.79 |
| (2) | 1.945 | 0.90 | 1.942 | 0.77 | 1.945 | 0.75 |
| (3) | 1.944 | 0.89 | 1.940 | 0.74 | 1.936 | 0.72 |
| 4 (1) | 1.944 | 0.92 | 1.939 | 0.80 | 1.942 | 0.80 |
| (2) | 1.950 | 0.88 | 1.946 | 0.75 | 1.935 | 0.73 |
| (3) | 1.939 | 0.94 | 1.935 | 0.78 | 1.910 | 0.74 |
| 5 (non-application of agent, comparative example) | 1.948 | 0.90 | — | — | 1.947 | 0.90 |

EXAMPLE 7

Silicon steel slabs, which consisted of 0.075% of C, 3.22% of Si, 0.068% of Mn, 0.030% of Al, 0.024% of S, 0.08% of Cu, 0.10% of Sn and iron essentially in balance, were subjected to well known steps for producing a grain-oriented electrical steel sheet of hot-rolling, annealing, and cold-rolling. The 0.225 mm thick cold-rolled steel sheets were obtained. Subsequently, the well known steps of decarburization annealing, application of annealing separator mainly composed of MgO, and finishing annealing were carried out.

A solution for forming an insulating coating was then applied on the finishing-annealed steel sheets and baked. During the baking, the heat-flattening annealing was also performed. The samples obtained from the steel sheets with the insulating coating, are denoted as "heat treatment". These steel sheets were irradiated with $CO_2$ laser in a direction virtually perpendicular to the rolling direction and with a space distance of 5 mm. The steel sheets were then subjected to an electroplating using the electrolyte solutions Nos. 1–6 containing Sb and Zn (No. 1), Sb and Zn (No. 2), Sb and Sn (No. 3), Sb and SbO (No. 4), Sb and SbO (No. 5), and none (No. 6, comparative example). The building up amounts of electroplating were 0.1, 1, and 10 $g/m^2$. The samples obtained from the steel sheets plated as above are denoted as "after treatment". The steel sheets were further subjected to a stress-relief annealing at 800° C. for 4 hours. These samples are denoted as "after stress-relief annealing". The magnetic properties of the samples before and after treatment and after stress relief-annealing were measured. The measurement results are shown in Table 10.

TABLE 10

| | | Magnetic Properties | | | | | |
|---|---|---|---|---|---|---|---|
| | | Before treatment | | After treatment | | After stress-relief annealing (800° C. × 4 H) | |
| Electrolyte Solution No. | Building-up Amount in Plating | $B_{10}$ (T) | $W_{17/50}$ (W/kg) | $B_{10}$ (T) | $W_{17/50}$ (W/kg) | $B_{10}$ (T) | $W_{17/50}$ (W/kg) |
| 1 (1) | 0.1 | 0.941 | 0.91 | 1.937 | 0.79 | 1.941 | 0.80 |
| (2) | 1.0 | 1.939 | 0.93 | 1.935 | 0.80 | 1.937 | 0.75 |
| (3) | 5.0 | 1.950 | 0.89 | 1.945 | 0.76 | 1.942 | 0.70 |
| 2 (1) | 0.1 | 1.952 | 0.88 | 1.947 | 0.78 | 1.952 | 0.81 |
| (2) | 1.0 | 1.950 | 0.89 | 1.948 | 0.78 | 1.947 | 0.76 |
| (3) | 5.0 | 1.940 | 0.92 | 1.934 | 0.80 | 1.936 | 0.75 |
| 3 (1) | 0.1 | 1.948 | 0.90 | 1.946 | 0.80 | 1.947 | 0.83 |
| (2) | 1.0 | 1.935 | 0.94 | 1.930 | 0.81 | 1.930 | 0.79 |
| (3) | 5.0 | 1.951 | 0.87 | 1.940 | 0.76 | 1.943 | 0.71 |
| 4 (1) | 0.1 | 1.945 | 0.92 | 1.942 | 0.78 | 1.945 | 0.82 |
| (2) | 1.0 | 1.939 | 0.94 | 1.933 | 0.82 | 1.935 | 0.78 |
| (3) | 5.0 | 1.940 | 0.90 | 1.933 | 0.77 | 1.928 | 0.77 |
| 5 (1) | 0.1 | 1.943 | 0.89 | 1.943 | 0.78 | 1.942 | 0.79 |
| (2) | 1.0 | 1.944 | 0.89 | 1.940 | 0.78 | 1.939 | 0.75 |
| (3) | 5.0 | 1.944 | 0.90 | 1.939 | 0.80 | 1.940 | 0.72 |
| 5 (non-application of agent, comparative example) | | 1.947 | 0.90 | — | — | 1.948 | 0.91 |

EXAMPLE 8

Silicon steel slabs, which consisted of 0.080% of C, 3.15% of Si, 0.075% of Mn, 0.029% of Al, 0.024% of S, 0.10% of Cu, 0.08% of Sn and iron essentially in balance, were subjected to well known steps for producing a grain-oriented electrical steel sheet of hot-rolling, annealing, and cold-rolling. The 0.225 mm thick cold-rolled steel sheets were obtained. Subsequently, the well known steps of decarburization annealing mainly composed of MgO, application of annealing separator and finishing annealing were carried out.

The samples obtained from the steel sheets having an insulating coating are denoted as "before treatment". These steel sheets were irradiated with laser in a direction virtually perpendicular to the rolling direction and with a space distance of 5 mm, so as to remove the glass film, insulating coating and oxide film. The steel sheets were then subjected to an electric plating using the electrolyte solutions Nos. 1–5 containing, as plating metals, Sb (No. 1—borofluoride bath), Mn (No. 2—borofluoride bath), Sn (No. 3—fluoride bath), Ni (No. 4—fluoride bath), and none (No. 5, comparative example). The samples obtained from the steel sheets plated as above are denoted by "after treatment". The steel sheets were further subjected to a stress-relief annealing at 800° C for 2 hours. The samples obtained from these steel sheets are denoted as "after stress-relief annealing". The magnetic properties of the samples before and after treatment and after stress-relief annealing were measured. The measurement results are shown in Table 11.

TABLE 11

| | Magnetic Properties | | | | | |
|---|---|---|---|---|---|---|
| | Before treatent | | After treatment | | After stress-relief annealing | |
| Electrolyte Solution Nos. | $B_{10}$ (T) | $W_{17/50}$ (W/kg) | $B_{10}$ (T) | $W_{17/50}$ (W/kg) | $B_{10}$ (T) | $W_{17/50}$ (W/kg) |
| 1 | 1.938 | 0.75 | 1.937 | 0.74 | 1.940 | 0.67 |
| 2 | 1.940 | 0.74 | 1.938 | 0.73 | 1.943 | 0.70 |
| 3 | 1.935 | 0.77 | 1.936 | 0.75 | 1.940 | 0.71 |
| 4 | 1.948 | 0.75 | 1.947 | 0.75 | 1.949 | 0.72 |
| 5 (non-application. of agent, comparative example) | 1.940 | 0.76 | — | — | 1.945 | 0.97 |

We claim:

1. A grain-oriented electrical steel sheet having an ultra low watt loss and exhibiting heat-resistant subdivision of magnetic domains, comprising:

said steel sheet having a predetermined silicon steel composition and a structure determined by finish annealing and an insulating coating on the surface thereof;

said steel sheet having thereon plastic strain regions which are spaced apart at a distance of 1 to 30 mm; and intruder means for subdividing said magnetic domains upon magnetization of said steel sheet and for causing said subdivided magnetic domains to be heat resistant, said intruder means being thermally diffused into said steel at locations wherein the locations of said diffused intruder means in said steel sheet are limited to said spaced apart regions of plastic strain, said diffused intruders being thereby spaced apart at said distance of 1 to 30 mm corresponding to said plastic strain regions; said intruder means maintaining said subdivided magnetic domains after relief annealing is carried out whereby said electrical steel sheet has a $W_{17/50}$ watt loss of from 0.64 to 0.92 (watt/kg) at a sheet thickness of from 0.18 to 0.30 mm after relief annealing is carried out.

2. A grain-oriented electrical steel sheet according to claim 1 wherein said intruders are formed by intrusion of intrudable means selected from the group consisting of: ZnO+Sn; Cu+Zn; Sn+Zn; $Cu+Na_2B_4O_4$; SnO; $MnO_2$; $Sb_2O_3+H_3BO_3$; $Sb+SrO_4$; $Sb_2O_3$; Cr; Ni; Zn; Mo; Cu; Mn; Al; Sr; Si; and Bi.

3. A grain-oriented electrical steel sheet according to claim 1 wherein the intrudable means for forming the intruders is at least one member selected from the group consisting of Sb, an Sb alloy, an Sb compound, and mixtures thereof.

4. A grain-oriented electrical steel sheet according to claim 1 or 2, wherein the intruders intrude by a depth of 2 μm or more.

5. A grain-oriented electrical steel sheet according to claim 1 or 2, wherein it further comprises a surface coating in contact with said body except for portions of said body, where said intruders are formed.

6. A grain-oriented electrical steel sheet according to claim 1, wherein said intrudable means is plated at a building up amount of 1 $g/m^2$ or more.

* * * * *

UNITED STATES PATENT AND TRADEMARK OFFICE

CERTIFICATE OF CORRECTION

PATENT NO. : 4,960,652

DATED : October 2, 1990

INVENTOR(S) : T. Wada et al.

It is certified that error appears in the above-identified patent and that said Letters Patent is hereby corrected as shown below:

On the title page, item [75] inventors: delete "Makato" and insert -- Makoto --.

Signed and Sealed this

Twenty-second Day of September, 1992

*Attest:*

DOUGLAS B. COMER

*Attesting Officer*

*Acting Commissioner of Patents and Trademarks*